US009607783B2

(12) United States Patent
Wu et al.

(10) Patent No.: US 9,607,783 B2
(45) Date of Patent: Mar. 28, 2017

(54) SWITCH DEVICE MOUNTING STRUCTURE

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Wu Yi Tsai, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 3 days.

(21) Appl. No.: 14/725,231

(22) Filed: May 29, 2015

(65) Prior Publication Data

US 2016/0012983 A1 Jan. 14, 2016

(30) Foreign Application Priority Data

Jul. 8, 2014 (TW) ..... 103123502 A

(51) Int. Cl.

| | |
|---|---|
| ***H01H 9/00*** | (2006.01) |
| ***H01H 9/08*** | (2006.01) |
| ***H01H 13/04*** | (2006.01) |
| ***H01H 9/20*** | (2006.01) |
| *H01H 9/22* | (2006.01) |
| *H01H 13/50* | (2006.01) |

(52) U.S. Cl.

CPC ..... *H01H 9/08* (2013.01); *H01H 9/20* (2013.01); *H01H 13/04* (2013.01); *H01H 9/223* (2013.01); *H01H 13/503* (2013.01)

(58) Field of Classification Search

CPC ..... H01R 4/48; H01R 4/4827; H01R 4/4836; H01R 9/2408; H01H 2071/0242; H01H 71/0214; H02G 3/086

USPC ..... 200/295; 361/601, 605, 634, 636, 652, 361/656; 439/716; 174/50, 58, 535

See application file for complete search history.

(56) References Cited

U.S. PATENT DOCUMENTS 3,992,074 A * 11/1976 Rymer ..... H01R 9/26 439/716

5,145,418 A * 9/1992 Moranski ..... H01R 9/2608 439/712

* cited by examiner

*Primary Examiner* — Vanessa Girardi

(74) *Attorney, Agent, or Firm* — Rosenberg, Klein & Lee

(57) ABSTRACT

A switch device structure includes at least one contact seat having a first end wall, a second end wall, two sidewalls, an upper section and a bottom section to together define a cavity for arranging a contact assembly. Each of the first and second end walls of the contact seat has a protruding assembling section and an oblique socket directed to the assembling section. The switch device structure includes a contact support equipped with a fixing board. The contact support is formed with latch sections detachably latched with the assembling sections. An operator can use a tool to directly pass through the oblique socket to unlatch the latch section from the assembling section to quickly install/uninstall the contact seat and the contact support. This solves the problem of the conventional switch device that it is troublesome and time-consuming to install/uninstall the contact seat and the contact support.

13 Claims, 4 Drawing Sheets

SWITCH DEVICE MOUNTING STRUCTURE

BACKGROUND OF THE INVENTION

1. Field of the Invention

The present invention relates generally to an improved switch device structure, and more particularly to a restriction switch device in which the contact seat has an assembling section and an oblique socket. An operator can use a tool to easily and quickly install/uninstall the contact seat and the contact support.

2. Description of the Related Art

A conventional switch indication device or switch device is applied to an electrical, electronic and automatic control system for an operator to operate or power on/off the system on the console. For example, a restriction switch or travel switch is applied to mechanical equipment for controlling the motional travel thereof. In general, the switch device is installed in a predetermined position. When a motional part of the mechanical equipment hits the contact of the restriction switch, the restriction switch will switch the circuits to control the travel of the mechanical equipment and provide terminal restriction protection.

The conventional restriction switch device generally includes multiple contact seats, which are side by side assembled with each other. The contact seats are fixedly connected with a contact fixing board by means of multiple screws and spring lock washers to form an integrated structure. Concerning the structure and application of such kind of restriction switch device, with a switch device with three side by side assembled contact seats and a contact fixing board connected with the contact seats taken as an example, in order to avoid loosening or detachment of the contact seats in operation of the mechanical equipment, two ends of each contact seat and the contact fixing board must be secured by screws and spring lock washers. Therefore, the restriction switch device totally has twelve screws (including six fastening screws of the contact fixing board) and six spring lock washers. As a result, the structure of the restriction switch device is quite complicated and it is quite troublesome and time-consuming to assemble/disassemble the restriction switch device. This leads to higher cost of the restriction switch device.

As known by those who are skilled in this field, in order to tighten over a dozen screws to lock the contact seats with the contact fixing board, the upper wall or lower wall of the conventional contact seat is generally in an open form. Such open structure is easy to cause mis-touch. This is not what we expect.

To speak representatively, the above reveals some shortcomings existing in the contact seats and the relevant connection components of the conventional switch device in use and structural design. In case the contact seats and the relevant components are redesigned to be different from the conventional switch device, the use form of the switch device can be changed to widen the application range thereof. For example, in comparison with the conventional switch device, the fixing mechanism including the screws and spring lock washers at two ends of each contact seat or the restriction switch is removed so as to facilitate the installation/uninstallation of the contact seats and the contact fixing board of the switch device. Under such circumstance, the structures of the contact seats and the contact fixing board are simplified and the contact seats and the contact fixing board can be more easily and quickly assembled/disassembled. Moreover, the possibility of mis-touch can be minimized. It is therefore tried by the applicant to provide an improved switch device structure to eliminate the above shortcomings existing in the conventional switch device.

SUMMARY OF THE INVENTION

It is therefore a primary object of the present invention to provide a switch device structure, which is advantageous in that the structure is simplified and the installation/uninstallation operation is facilitated. The switch device structure includes at least one contact seat having a first end wall, a second end wall, two sidewalls, an upper section and a bottom section to together define a cavity for arranging a contact assembly therein. Each of the first and second end walls of the contact seat has a protruding assembling section and an oblique socket directed to and related to the assembling section. The switch device structure further includes a contact support equipped with a fixing board. The contact support is formed with latch sections detachably latched with the assembling sections. An operator can use a tool to directly pass through the oblique socket to unlatch the latch section from the assembling section so as to quickly install/uninstall the contact seat and the contact support. This solves the problem of the conventional switch device that the components are complicated and it is troublesome and time-consuming to assemble/disassemble the contact seat and the contact support.

In the above switch device structure, corresponding to the assembling section of the contact seat, each latch section of the contact support has two protruding cantilevers and a connection section connected between the two cantilevers to together define a space for latching with the assembling section. The latch section has a U-shaped (cross section) configuration with elasticity.

In the above switch device structure, the connection section of the contact support is pressed onto the assembling section and positioned in an inclined path of the oblique socket. Accordingly, an operator can use a tool to directly pass through the oblique socket to push away the latch section for quickly installing/uninstalling the contact seat and the contact support.

The present invention can be best understood through the following description and accompanying drawings, wherein:

DETAILED DESCRIPTION OF THE PREFERRED EMBODIMENTS

Figure 1:
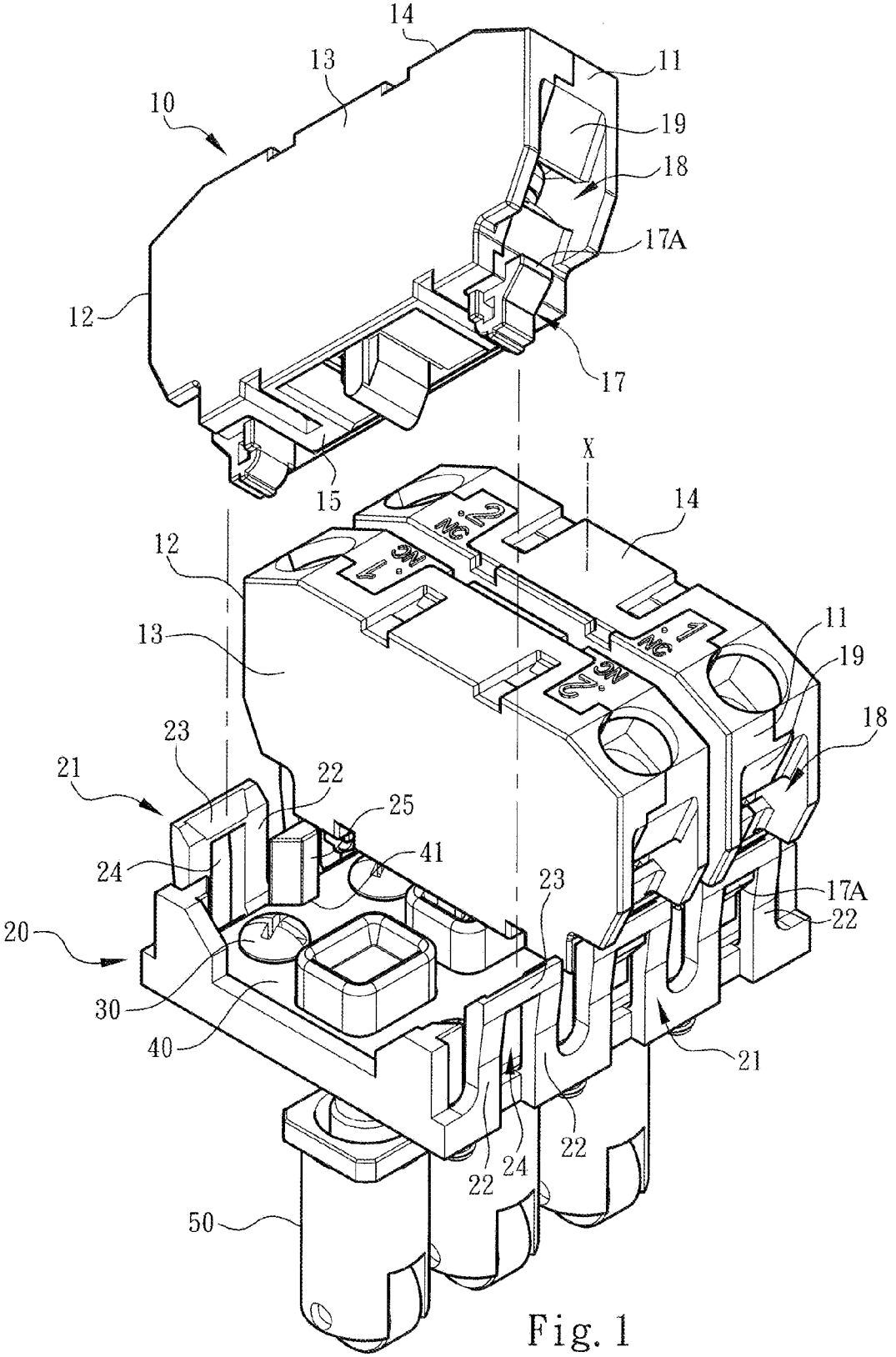
FIG. 1 is a perspective assembled view of the restriction switch device of the present invention, showing that the contact seats are side by side assembled and latched with the contact support and the contact support is secured on the fixing board and the operation rods are side by side arranged.
Figure 2:
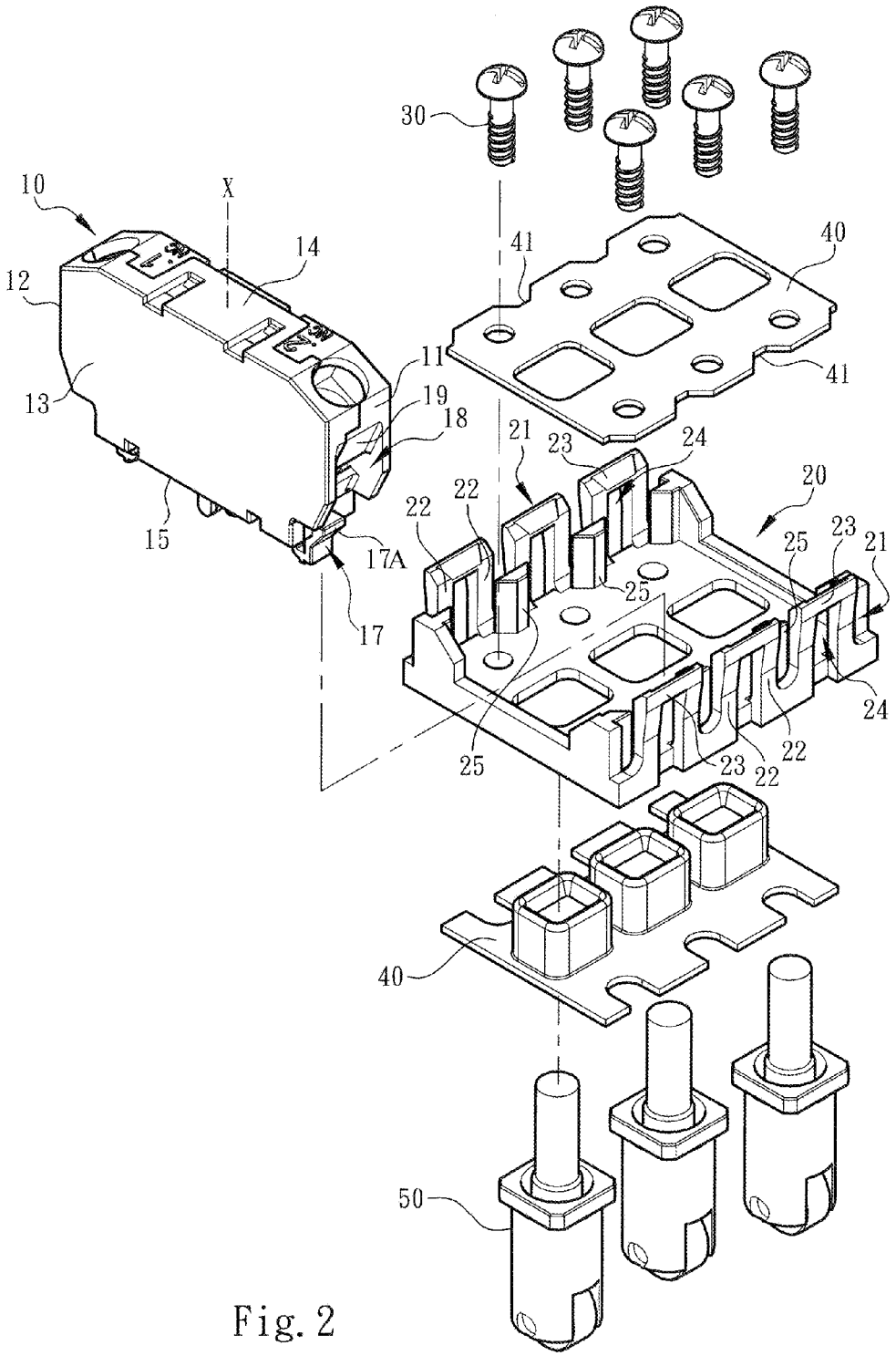
FIG. 2 is a perspective exploded view according to FIG. 1, showing the structures of the contact seats, the fixing board, the contact support and the operation rods.
Figure 3:
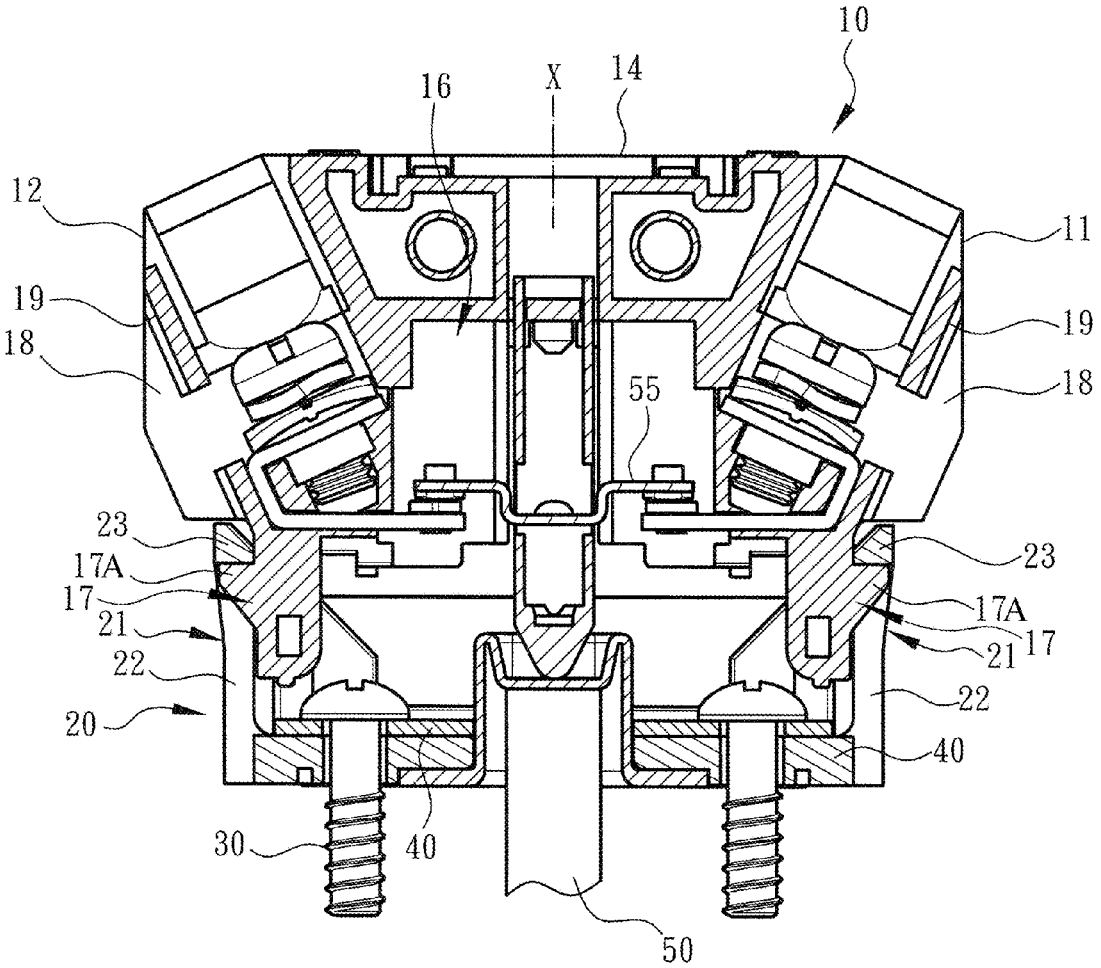
FIG. 3 is a plane sectional view of the restriction switch device of the present invention, showing that the contact seats are latched with the contact support and the contact support is secured on the fixing board and the operation rods are assembled with the contact support.

Please refer to FIGS. 1, 2 and 3. According to a preferred embodiment, the switch device structure of the present invention is a restriction or travel switch device for illustration. The switch device structure has three contact seats 10 side by side assembled with each other and a contact support 20 latched with the contact seats 10. The contact support 20 is fixed with a fixing board assembly or fixing board 40 by screws 30. The fixing board 40 permits an operation rod 50 to extend into the contact support 20 to touch the contact seat 10. This achieves an effect similar to the conventional restriction switch.

In this embodiment, the contact seat 10 has an insulation case body defined with an axis $\chi$. The contact seat 10 has a first end wall 11, a second end wall 12, two sidewalls 13, an upper section 14 and a bottom section 15 to together define a cavity 16 for arranging a contact assembly 55 therein. The contact seat 10 has an assembling section 17 protruding from the first end wall 11 and/or the second end wall 12 and an oblique socket 18 directed to and related to the assembling section 17. The assembling section 17 includes a shoulder section 17A positioned near the bottom section 15 in a direction away from the axis $\chi$. In addition, two ends of the contact support 20 are respectively formed with latch sections 21 corresponding to the assembling section 17 and the oblique socket 18. As shown in the drawings, multiple continuously arranged latch sections 21 are formed at two ends of the contact support 20 in accordance with the number of the contact seats 10. The assembling sections 17 of the contact seats 10 are detachably latched with the latch sections 21 to form an integrated structure.

To speak more specifically, each latch section 21 of the contact support 20 has two protruding cantilevers 22 and a connection section 23 connected between the two cantilevers 22 to together define a space 24. Accordingly, the latch section 21 has a U-shaped (cross section) configuration with elasticity. As also shown in the drawings, the oblique socket 18 is a structure inclined from the first and second end walls 11, 12 to the axis $\chi$. The oblique socket 18 includes a slope 19 inclined to the axis $\chi$ for supporting and guiding a tool to insert into the contact seat 10. (This will be further described hereinafter.)

FIG. 2 also shows that the contact support 20 is formed with at least one stake 25 positioned between the adjacent latch sections 21 and having trapezoidal cross section. The edge of the fixing board 40 is formed with notches 41 in alignment with the stakes 25 for assembling or inlaying the stakes 25. Accordingly, the fixing board 40 can be securely assembled with the contact support 20.

FIG. 3 especially shows that an operator can directly operate the latch sections 21 to latch with the assembling sections 17 of the contact seat 10 to assemble the contact support 20 with the contact seat 10. As shown in the drawings, the assembling section 17 is relatively positioned in the space 24 of the contact support 20 with the connection section 23 pressed onto the assembling section 17. In this case, the connection section 23 is positioned in the inclined path of the oblique socket 18.

Figure 4:
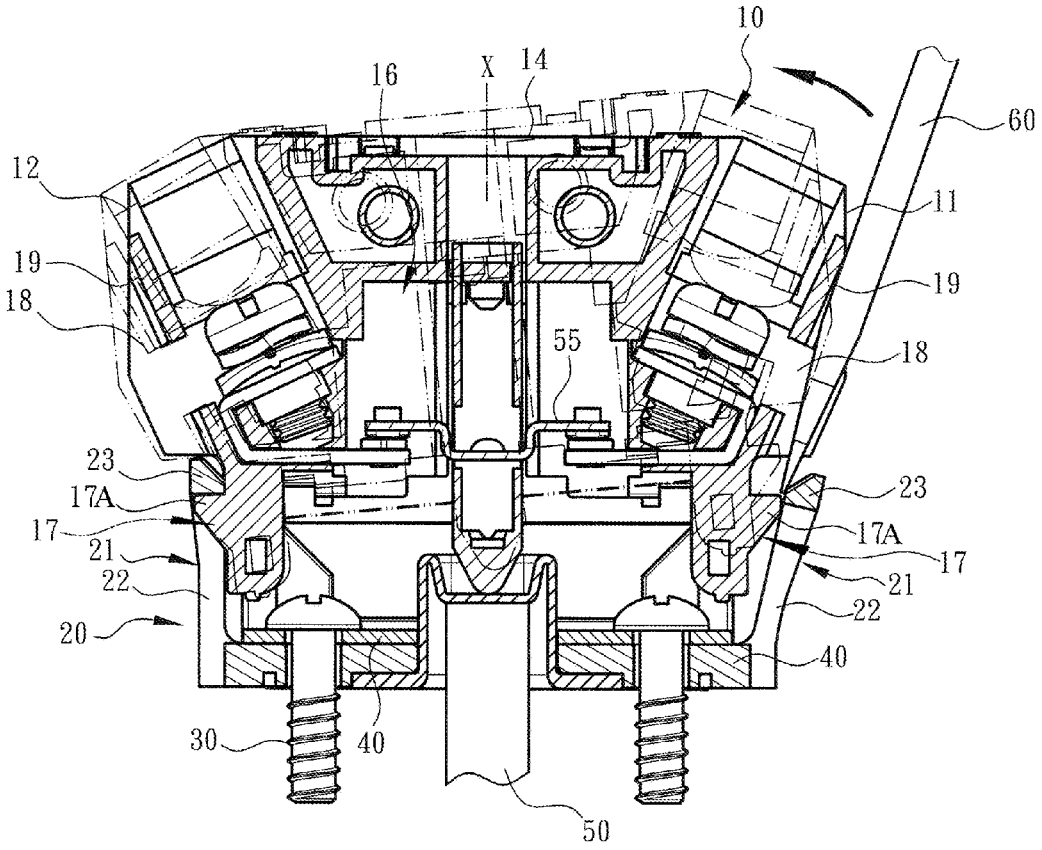
FIG. 4 is a plane sectional view of the restriction switch device of the present invention, showing that an operator use a tool to directly pass through the oblique socket to unlatch the latch section from the assembling section to quickly install/uninstall the contact seat and the contact support.

Please refer to FIG. 4. An operator can use a tool 60 (such as a screwdriver) to pass through the oblique socket 18 and directly push away the connection section 23 of the latch section 21 from the assembling section 17 with the slope 19 serving as a (force application) fulcrum. Accordingly, the contact seat 10 and the contact support 20 can be quickly installed/uninstalled. This improves the shortcoming of the conventional switch device that it is necessary to troublesomely and time-consumingly tighten over a dozen screws or install multiple spring lock washers for assembling/disassembling the contact seat and the contact support.

According to the above, in the condition that the structure is simplified and the operation is facilitated, in comparison with the conventional switch device, the switch device structure of the present invention has the following advantages:

1. The contact seat 10, the contact support 20 and the relevant components and structures have been redesigned, and each contact seat 10, the contact support 20 and the relevant fixing structures latched with each other have been specifically considered to be different from the conventional switch device and change the usage and operation form thereof. For example, the first and second end walls 11, 2 of the contact seat 10 are formed with assembling sections 17 in a direction away from the axis $\chi$. The first and second end walls 11, 2 of the contact seat 10 are formed with oblique sockets 18 in a direction to the axis $\chi$. Two ends of the contact support 20 are formed with latch sections 21, cantilevers 22, connection sections 23 and spaces 24, whereby the latch sections 21 have elasticity. This obviously changes the structures and textures of the conventional switch device and solves the problem of the conventional switch device that when replacing or install/uninstall the switch device, it is necessary to troublesomely and time-consumingly tighten over a dozen screws or install multiple spring lock washers for assembling/disassembling the contact seat and the contact fixing support.
2. The latch section 21 of the contact support 20 permits an operator to directly latch and assemble the contact support 20 with the assembling section 17 of the contact seat 10 or use a tool 60 to push away the latch section 21 under the guide of the oblique socket 18 with the slope 19 serving as a fulcrum. Accordingly, the contact seat 10 and the contact support 20 can be easily and quickly assembled/disassembled. Especially, in comparison with the conventional contact seat structure, the structural design and assembling pattern of the contact seat 10 and the contact support 20 allow the upper section 14 and/or bottom section 15 of the contact seat 10 form an as closed as possible structure. This minimizes the possibility of mis-touch that often takes place in the conventional switch device.

In conclusion, the switch device structure of the present invention is different from the conventional switch device in space form and is advantageous over the conventional switch device. The shift assembly structure of switch device of the present invention is novel and inventive.

The above embodiments are only used to illustrate the present invention, not intended to limit the scope thereof. Many modifications of the above embodiments can be made without departing from the spirit of the present invention.

What is claimed is:

1. A switch device structure comprising:

at least one contact seat defined with an axis, the contact seat having a first end wall, a second end wall, two sidewalls, an upper section and a bottom section to together define a cavity for arranging a contact assembly therein, each of the first and second end walls of the contact seat having a protruding assembling section and an oblique socket directed to and related to the assembling section; and a contact support equipped with a fixing board, the contact support being formed with latch sections detachably latched with the assembling sections;

wherein the contact support is formed with at least one stake positioned between the adjacent latch sections and an edge of the fixing board is formed with notches in alignment with the stakes for assembling with the stakes.

2. A switch device structure comprising:

at least one contact seat defined with an axis, the contact seat having a first end wall, a second end wall, two sidewalls, an upper section and a bottom section to together define a cavity for arranging a contact assembly therein, each of the first and second end walls of the contact seat having a protruding assembling section and an oblique socket directed to and related to the assembling section; and a contact support equipped with a fixing board, the contact support being formed with latch sections detachably latched with the assembling sections;

wherein the oblique socket permits a tool to pass through to directly push a connection section of the latch section away from the assembling section.

3. A switch device structure comprising:

at least one contact seat defined with an axis, the contact seat having a first end wall, a second end wall, two sidewalls, an upper section and a bottom section to together define a cavity for arranging a contact assembly therein, each of the first and second end walls of the contact seat having a protruding assembling section and an oblique socket directed to and related to the assembling section; and a contact support equipped with a fixing board, the contact support being formed with latch sections detachably latched with the assembling sections;

wherein the assembling section includes a shoulder section positioned near the bottom section of the contact seat in a direction away from the axis, and two ends of the contact support being respectively formed with the latch sections corresponding to the assembling sections and the oblique sockets, each latch section having two protruding cantilevers and a connection section connected between the two cantilevers to together define a space, whereby the latch section has a U-shaped configuration with elasticity, the oblique socket being a structure inclined from each of the first and second end walls to the axis, the oblique socket including a slope inclined to the axis;

wherein the assembling section is relatively positioned in the space of the contact support with the connection section pressed onto the assembling section and the connection section is positioned in an inclined path of the oblique socket.

4. The switch device structure as claimed in claim 3, wherein the oblique socket permits a tool to pass through to directly push the connection section of the latch section away from the assembling section with the slope serving as a force application fulcrum.

5. The switch device structure as claimed in claim 3, wherein the oblique socket permits a tool to pass through to directly push the connection section of the latch section away from the assembling section.

6. The switch device structure as claimed in claim 3, wherein multiple continuously arranged latch sections are formed at two ends of the contact support.

7. The switch device structure as claimed in claim 6, wherein the oblique socket permits a tool to pass through to directly push the connection section of the latch section away from the assembling section.

8. The switch device structure as claimed in claim 6, wherein the contact support is formed with at least one stake positioned between the adjacent latch sections and an edge of the fixing board is formed with notches in alignment with the stakes for assembling with the stakes.

9. The switch device structure as claimed in claim 3, wherein three latch sections are formed at at a first end of the contact support and three latch sections are formed at a second opposing end thereof.

10. The switch device structure as claimed in claim 9, wherein the oblique socket permits a tool to pass through to directly push the connection section of the latch section away from the assembling section.

11. The switch device structure as claimed in claim 9, wherein the contact support is formed with at least one stake positioned between the adjacent latch sections and an edge of the fixing board is formed with notches in alignment with the stakes for assembling with the stakes.

12. The switch device structure as claimed in claim 3, wherein the contact support is formed with at least one stake positioned between the adjacent latch sections and an edge of the fixing board is formed with notches in alignment with the stakes for assembling with the stakes.

13. The switch device structure as claimed in claim 12, wherein the contact support is formed with three stakes at a first end of the contact support and three stakes at a second opposing end thereof.

* * * * *